US009803867B2

(12) United States Patent
Stewart

(10) Patent No.: US 9,803,867 B2
(45) Date of Patent: Oct. 31, 2017

(54) PREMIX PILOT NOZZLE

(71) Applicant: General Electric Company, Schenectady, NY (US)

(72) Inventor: Jason Thurman Stewart, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 280 days.

(21) Appl. No.: 14/691,864

(22) Filed: Apr. 21, 2015

(65) Prior Publication Data

US 2016/0313006 A1 Oct. 27, 2016

(51) Int. Cl.

| | |
|---|---|
| ***F23R 3/00*** | (2006.01) |
| ***F23R 3/28*** | (2006.01) |
| ***F23R 3/34*** | (2006.01) |
| ***F23D 14/78*** | (2006.01) |

(52) U.S. Cl.

CPC ..... *F23R 3/286* (2013.01); *F23D 14/78* (2013.01); *F23R 3/343* (2013.01); *F23R 2900/03343* (2013.01)

(58) Field of Classification Search

None

See application file for complete search history.

(56) References Cited

U.S. PATENT DOCUMENTS

| | | | |
|---|---|---|---|
| 4,100,733 | A | 7/1978 | Striebel et al. |
| 4,589,260 | A | 5/1986 | Krockow |
| 4,850,194 | A | 7/1989 | Fuglistaller et al. |
| 4,890,453 | A | 1/1990 | Iwai et al. |
| 4,982,570 | A | 1/1991 | Waslo et al. |
| 5,199,265 | A | 4/1993 | Borkowicz |
| 5,263,325 | A | 11/1993 | McVey et al. |
| 5,675,971 | A | 10/1997 | Angel et al. |
| 5,755,090 | A | 5/1998 | Hu |
| 6,298,667 | B1 | 10/2001 | Glynn et al. |
| 6,363,724 | B1 | 4/2002 | Bechtel et al. |
| 6,438,961 | B2 | 8/2002 | Tuthill et al. |

(Continued)

FOREIGN PATENT DOCUMENTS

| | | |
|---|---|---|
| EP | 2405201 A2 | 1/2012 |
| EP | 2693123 A1 | 2/2014 |
| WO | WO 2014/081334 | 5/2014 |

OTHER PUBLICATIONS

A US Non-Final Office Action issued in connection with related U.S. Appl. No. 14/102,846 dated Mar. 24, 2016.

(Continued)

*Primary Examiner* — Pascal M Bui Pho
*Assistant Examiner* — Kyle Thomas
(74) *Attorney, Agent, or Firm* — Dority & Manning, P.A.

(57) ABSTRACT

A premix pilot nozzle includes a tip portion having a downstream surface that extends between a downstream end of an inner wall of the tip portion and a downstream end of an outer wall of the tip portion. The downstream end of the inner wall terminates axially upstream from the downstream end of the outer wall. At least a portion of the downstream surface is curvilinear. The tip portion further comprises a plurality of axially extending premix tubes annularly arranged about the tip portion. Each premix tube defines a premix flow passage through the tip portion. Each premix tube also includes an outlet that is axially offset from the downstream surface.

8 Claims, 6 Drawing Sheets

(56) References Cited

U.S. PATENT DOCUMENTS

| | | | | |
|---|---|---|---|---|
| 6,446,439 | B1 | 9/2002 | Kraft et al. | |
| 6,609,380 | B2 | 8/2003 | Mick et al. | |
| 6,857,271 | B2 | 2/2005 | Kraft et al. | |
| 7,007,477 | B2 | 3/2006 | Widener | |
| 7,854,121 | B2 | 12/2010 | Vandale et al. | |
| 8,240,150 | B2 | 8/2012 | Varatharajan et al. | |
| 8,347,631 | B2 | 1/2013 | Bailey et al. | |
| 8,919,673 | B2 | 12/2014 | Subramanian et al. | |
| 9,297,535 | B2 | 3/2016 | Uhm et al. | |
| 2009/0165436 | A1 | 7/2009 | Herbon et al. | |
| 2009/0223228 | A1* | 9/2009 | Romoser | F02C 7/264 60/776 |
| 2010/0031661 | A1 | 2/2010 | Varatharajan et al. | |
| 2010/0084490 | A1 | 4/2010 | Zuo et al. | |
| 2010/0293955 | A1 | 11/2010 | Berry et al. | |
| 2010/0319353 | A1 | 12/2010 | Intile | |
| 2011/0005229 | A1 | 1/2011 | Venkataraman et al. | |
| 2011/0162371 | A1 | 7/2011 | Khan et al. | |
| 2011/0252803 | A1 | 10/2011 | Subramanian et al. | |
| 2012/0073302 | A1 | 3/2012 | Myers et al. | |
| 2012/0096866 | A1 | 4/2012 | Khan et al. | |
| 2012/0167586 | A1 | 7/2012 | Bailey et al. | |
| 2012/0192565 | A1 | 8/2012 | Tretyakov et al. | |
| 2013/0219899 | A1 | 8/2013 | Uhm et al. | |
| 2013/0219903 | A1 | 8/2013 | Koizumi et al. | |
| 2013/0306181 | A1 | 11/2013 | Mitchell et al. | |
| 2013/0312422 | A1 | 11/2013 | Westmoreland et al. | |
| 2014/0041389 | A1* | 2/2014 | Kajimura | F23D 14/24 60/737 |

OTHER PUBLICATIONS

A US Notice of Allowance issued in connection with related U.S. Appl. No. 14/102,846 dated Jul. 6, 2016.

A European Search Report and Opinion issued in connection with corresponding EP Application No. 16165555.0 dated Sep. 13, 2016.

A GB Search Report and Opinion issued in connection with related GB Application No. 1606106.1 dated Oct. 13, 2016.

A US Non-Final Office Action issued in connection with related U.S. Appl. No. 14/555,143 dated Nov. 31, 2016.

Copending U.S. Appl. No. 14/555,143, filed Nov. 26, 2014.

Copending U.S. Appl. No. 14/688,170, filed Apr. 16, 2015.

Copending U.S. Appl. No. 14/555,074, filed Nov. 26, 2014.

Copending U.S. Appl. No. 14/102,846, filed Dec. 11, 2013.

Co-pending U.S. Appl. No. 15/221,747, Berry et al., filed Jul. 28, 2016.

* cited by examiner

PREMIX PILOT NOZZLE

FIELD OF THE INVENTION

The present invention generally involves a fuel nozzle assembly for a gas turbine combustor. More specifically, the invention relates to a fuel nozzle assembly having a premix pilot nozzle.

BACKGROUND OF THE INVENTION

Gas turbines are widely used in industrial and power generation operations. A gas turbine generally includes, in serial flow order, a compressor, a combustion section and a turbine. The combustion section may include multiple combustors annularly arranged around an outer casing. In operation, a working fluid such as ambient air is progressively compressed as it flows through the compressor. A portion of the compressed working fluid is routed from the compressor to each of the combustors where it is mixed with a fuel and burned in a combustion zone to produce combustion gases. The combustion gases are routed through the turbine along a hot gas path where thermal and/or kinetic energy is extracted from the combustion gases via turbine rotors blades coupled to a rotor shaft, thus causing the rotor shaft to rotate and produce work and/or thrust.

Some combustion systems utilize a plurality of premix type fuel nozzles. For example, some combustors include a center or primary premix fuel nozzle and a plurality of secondary premix fuel nozzles annularly arranged around the center fuel nozzle. This arrangement of fuel nozzles may provide for fuel staging, desired emissions performance, and flame stability.

At least one of the fuel nozzles may include a premix pilot nozzle. The premix pilot nozzle may be coaxially aligned with a center body portion of the corresponding fuel nozzle and may be disposed at a distal end of the center body upstream from the combustion zone. During particular combustion operation modes, the premix pilot nozzle may deliver a premixed fuel and air mixture to the combustion zone to produce a pilot flame. The pilot flame is generally used to ensure flame stability as the combustor is operated in certain modes and/or when the combustor transitions between various modes of operation.

The premix pilot nozzle generally includes a tip portion having a flat or planer downstream surface that is positioned proximate to the combustion zone. Multiple fuel ports and/or air passages extend through the downstream surface and provide for fluid communication of the premixed fuel and air out of the tip portion. The base of the pilot flame resides adjacent to or just downstream from the downstream surface. As a result, the downstream surface is exposed to extremely high temperatures.

One solution for cooling the downstream surface of the tip portion may include directing air across an upstream or backside or surface of the tip. Another technique for cooling the downstream surface may include directing cooling air across the generally planer downstream surface. However, this technique may result in flame instability when the cooling air strikes the pilot flame at or near the base of the pilot flame. In addition or in the alternative, various coatings such as thermal barrier coatings and/or anti-oxidation coatings may be applied to the downstream surface to achieve desired component life, reduce thermal stresses and to reduce deposit formation on the downstream surface.

Although these solutions are effective for reducing or managing cooling of the tip portion of a pilot premix nozzle, an improved premix pilot nozzle that reduces flame instability while providing cooling to the downstream end of the tip portion would be useful in the art.

BRIEF DESCRIPTION OF THE INVENTION

Aspects and advantages of the invention are set forth below in the following description, or may be obvious from the description, or may be learned through practice of the invention.

One embodiment of the present invention is a pilot premix nozzle. The pilot premix nozzle includes a tip portion having a downstream surface that extends between a downstream end of an inner wall of the tip portion and a downstream end of an outer wall of the tip portion. The downstream end of the inner wall terminates axially upstream from the downstream end of the outer wall. At least a portion of the downstream surface is curvilinear. The tip portion further comprises a plurality of axially extending premix tubes annularly arranged about the tip portion. Each premix tube defines a premix flow passage through the tip portion. Each premix tube also includes an outlet that is axially offset from the downstream surface.

Another embodiment of the present disclosure is a fuel nozzle assembly. The fuel nozzle assembly includes a center body that extends axially along a center line of the fuel nozzle assembly. The center body includes a pilot fuel circuit and a pilot air circuit defined therein. The fuel nozzle assembly further includes a premix pilot nozzle that extends axially within the center body. The premix pilot nozzle comprises a tip portion. The tip portion includes a downstream surface that extends between a downstream end of an inner wall of the tip portion and a downstream end of an outer wall of the tip portion. The downstream end of the inner wall terminates axially upstream from the downstream end of the outer wall. At least a portion of the downstream surface is curvilinear. The tip portion further comprises a plurality of axially extending premix tubes that is annularly arranged about the tip portion. Each premix tube includes an outlet that is axially offset from the downstream surface. Each tube defines a premix flow passage through the tip portion that terminates downstream from the downstream surface.

Another embodiment of the present disclosure is a combustor. The combustor includes an end cover and a plurality of fuel nozzle assemblies annularly arranged about a center fuel nozzle. Each fuel nozzle assembly of the plurality of fuel nozzle assemblies and the center fuel nozzle are fixedly connected to the end cover. At least one fuel nozzle assembly of the plurality of fuel nozzle assemblies includes a center body that extends axially along a center line of the fuel nozzle assembly and that includes a pilot fuel circuit and a pilot air circuit defined therein. A premix pilot nozzle extends axially within the center body. The premix pilot nozzle includes a tip portion comprising a downstream surface that extends between a downstream end of an inner wall of the tip portion and a downstream end of an outer wall of the tip portion. The downstream end of the inner wall terminates axially upstream from the downstream end of the outer wall and at least a portion of the downstream surface is curvilinear. The tip portion further comprises a plurality of axially extending premix tubes annularly arranged about the tip portion. Each premix tube includes an outlet axially offset from the downstream surface and wherein each tube defines a premix flow passage through the tip portion that terminates downstream from the downstream surface.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
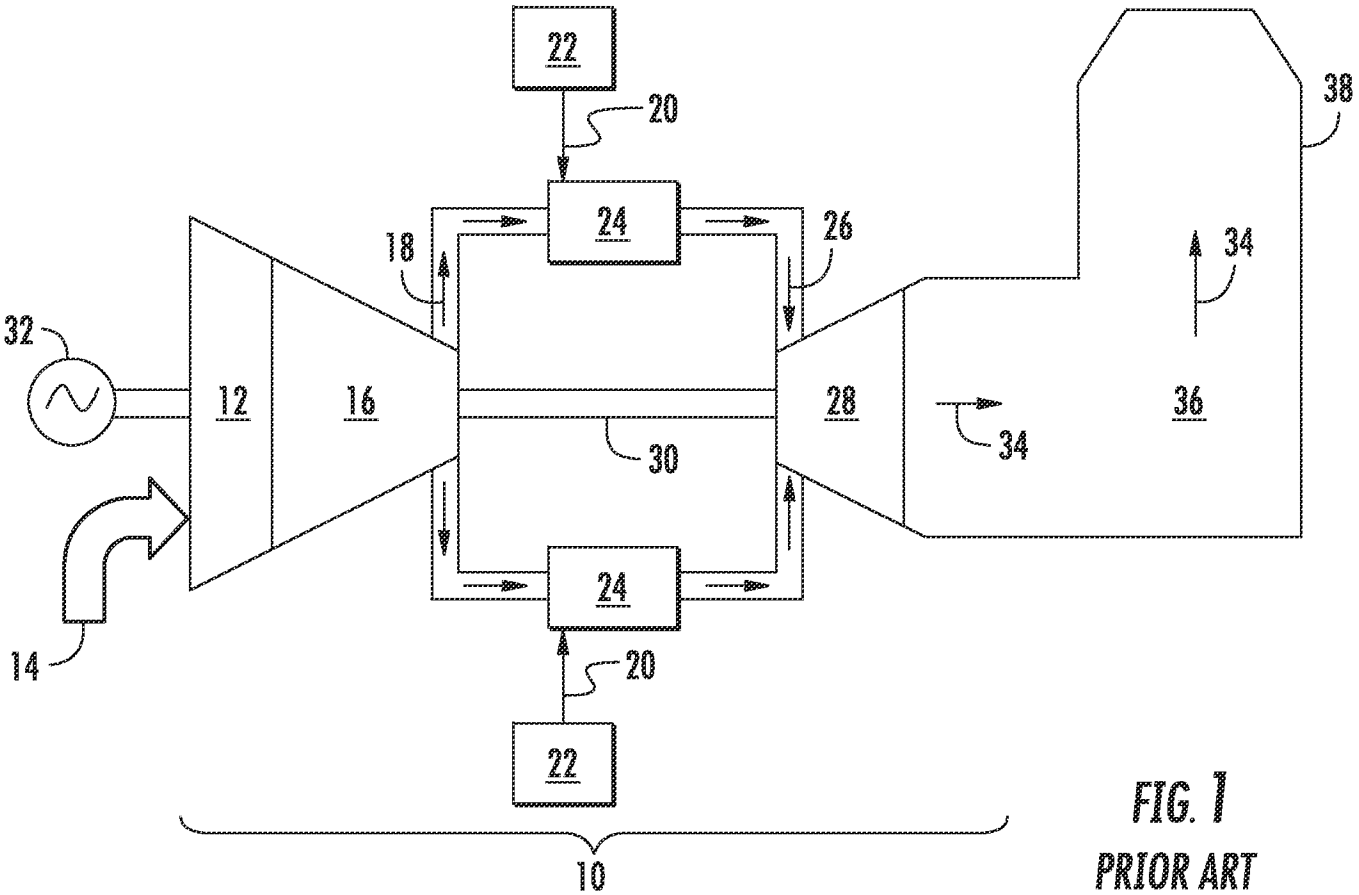
FIG. 1 PRIOR ART
FIG. 1 is a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a premix fuel nozzle assembly for a land based power generating gas turbine combustor for purposes of illustration, one of ordinary skill in the art will readily appreciate that embodiments of the present invention may be applied to any style or type of combustor for a turbomachine and are not limited to combustors or combustion systems for land based power generating gas turbines unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition air 14 or other working fluid entering the gas turbine 10. The air 14 flows to a compressor section where a compressor 16 progressively imparts kinetic energy to the air 14 to produce compressed air 18.

The compressed air 18 is mixed with a fuel 20 from a fuel supply system 22 to form a combustible mixture within one or more combustors 24. The combustible mixture is burned to produce combustion gases 26 having a high temperature, pressure and velocity. The combustion gases 26 flow through a turbine 28 of a turbine section to produce work. For example, the turbine 28 may be connected to a shaft 30 so that rotation of the turbine 28 drives the compressor 16 to produce the compressed air 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
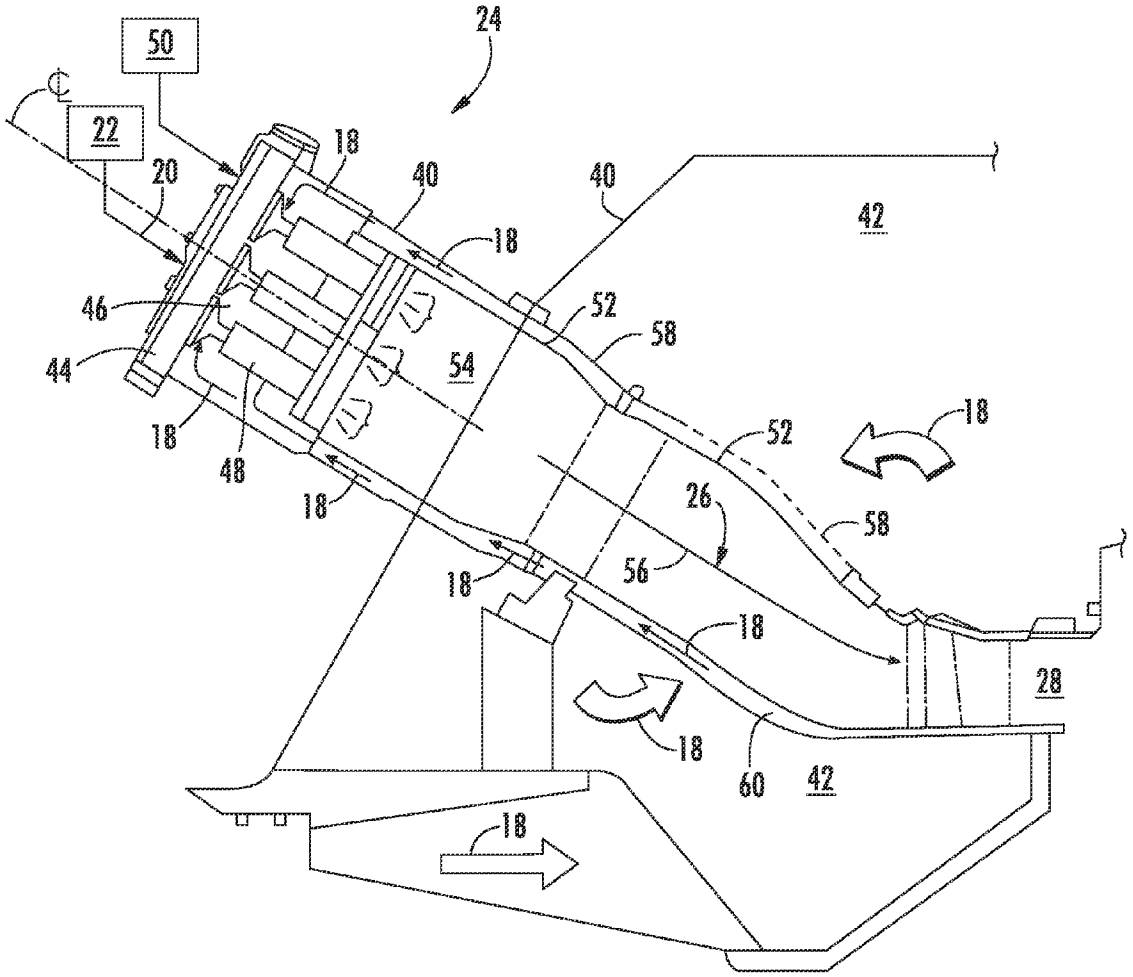
FIG. 2 is a side view of an exemplary combustor as may incorporate various embodiments of the present invention.

The combustor 24 may be any type of combustor known in the art, and the present invention is not limited to any particular combustor design unless specifically recited in the claims. For example, the combustor 24 may be a can-annular or an annular combustor. FIG. 2 provides a perspective side view of a portion of an exemplary combustor 24 as may be incorporated in the gas turbine 10 shown in FIG. 1 and as may incorporate one or more embodiments of the present invention.

In an exemplary embodiment, as shown in FIG. 2, the combustor 24 is at least partially surrounded by an outer casing 40 such as a compressor discharge casing. The outer casing 40 may at least partially define a high pressure plenum 42 that at least partially surrounds the combustor 24. The high pressure plenum 42 is in fluid communication with the compressor 16 (FIG. 1) so as to receive the compressed air 18 therefrom. An end cover 44 may be coupled to the outer casing 40. The outer casing 40 and the end cover 44 may at least partially define a head end portion 46 of the combustor 24.

One or more fuel nozzle assemblies 48 extend axially downstream from the end cover 44 within and/or through the head end 46. At least some of the fuel nozzle assemblies 48 may be in fluid communication with the fuel supply system 22 via the end cover 44. In particular embodiments, at least one of the fuel nozzle assemblies 48 may be in fluid communication with an extraction air supply 50 for example, via the end cover 44.

The combustor 24 may also include one or more liners 52 such as a combustion liner and/or a transition duct that at least partially define a combustion chamber 54 within the outer casing 40. The liner(s) 52 may also at least partially define a hot gas path 56 for directing the combustion gases 26 into the turbine 28. In particular configurations, one or more flow or impingement sleeves 58 may at least partially surround the liner(s) 52. The flow sleeve(s) 58 may be radially spaced from the liner(s) 52 so as to define an annular flow path 60 for directing a portion of the compressed air 18 towards the head end portion 46 of the combustor 24.

Figure 3:
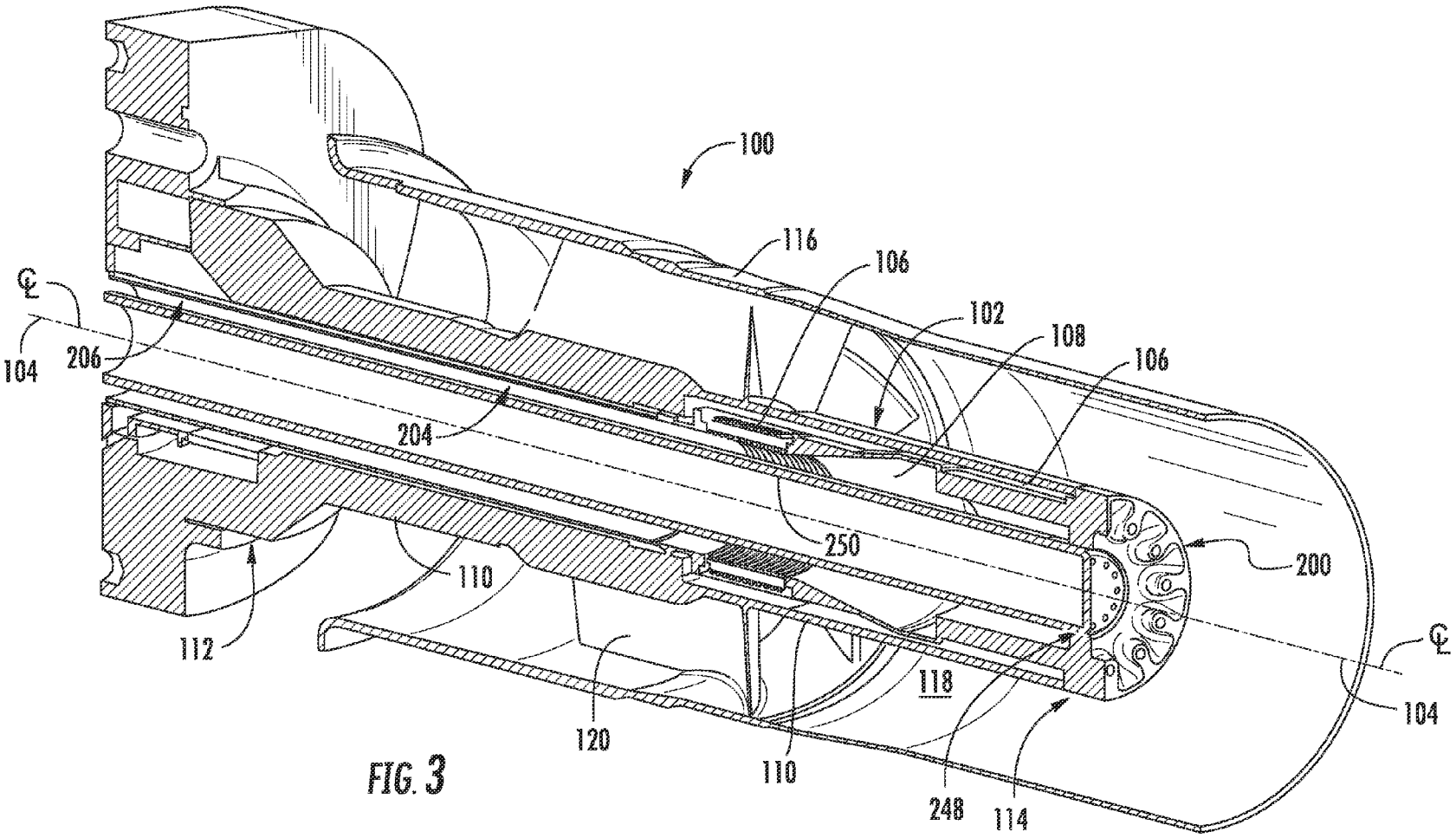
FIG. 3 is a perspective cross sectioned side view of a an exemplary fuel nozzle assembly as may incorporate one or more embodiments of the present invention.
Figure 4:
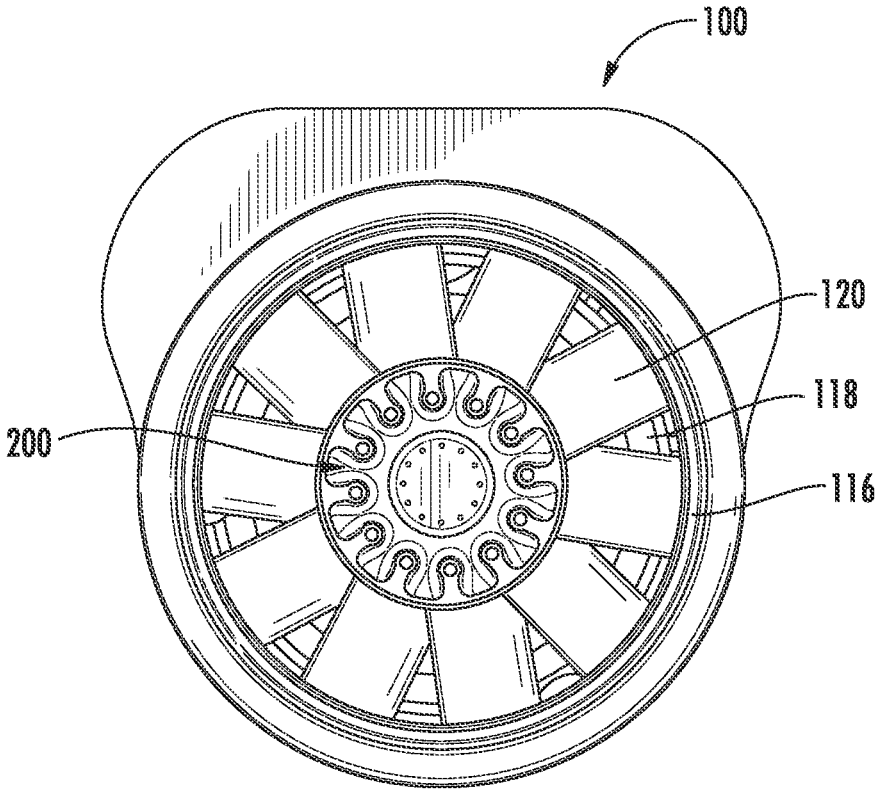
FIG. 4 is an upstream view of the fuel nozzle assembly as provided in FIG. 3.

FIG. 3 provides a perspective cross sectioned side view of an exemplary premix type fuel nozzle assembly 100 according to one or more embodiments of the present invention and as may be incorporated into the combustor 24 as shown in FIG. 2. FIG. 4 provides an upstream view of the fuel nozzle assembly 100 as shown in FIG. 3. Fuel nozzle assembly 100 may be representative of one, any or all of the fuel nozzle assemblies 48 shown in FIG. 2 and is not limited to any particular location or position along the end cover 44 or within the combustor 24 unless otherwise recited in the claims. In particular embodiments, the fuel nozzle assembly 100 may be configured as a "dual fuel" type fuel nozzle assembly, as a result, the fuel nozzle assembly 100 as provided herein may be configured or modified to burn or operate on either a gaseous fuel or a liquid fuel or both.

As shown in FIG. 3, the fuel nozzle assembly 100 generally includes a center body 102. The center body 102 extends axially along a center line 104 of the fuel nozzle assembly 100. A pilot fuel circuit 106 is defined within the center body 102. A pilot air circuit or passage 108 is also defined within the center body 102. In particular embodiments, the pilot fuel circuit 106 is in fluid communication with the fuel supply system 22 (FIG. 2). In particular embodiments, the pilot air circuit 108 may be in fluid communication with at least one of the head end 46 (FIG. 2) of the combustor and/or the extraction air supply 50 (FIG. 2). As shown in FIG. 3, the center body 102 is generally annular and may comprise of a singular tube 110 or a plurality of tubes 110 joined together to form a singular or continuous center body 102. The center body 102 generally includes an upstream end portion 112 that is axially spaced from a downstream end portion 114.

In particular embodiments, as shown in FIGS. 3 and 4, the fuel nozzle assembly 100 may include an outer sleeve 116. The outer sleeve 116 is substantially coaxially aligned with and radially spaced from the center body 102 so as to define an annular passage 118 therebetween. A plurality of swirler vanes 120 may extend radially outwardly from the center body 102 to the outer sleeve 116. The swirler vanes 120 may be configured to impart angular swirl about the centerline 104 to a portion of the compressed air 18 that flows through the annular passage 118 during operation of the combustor 24.

In certain operational modes, a portion of the compressed air 18 from the high pressure plenum 42 enters the annular passage 118 of the fuel nozzle assembly 100 where the swirler vanes 120 impart angular swirl to the compressed air 18 as it flows through the annular passage 118. A gaseous fuel such as natural gas is injected into the flow of compressed air 18. The gaseous fuel mixes with the compressed air 18 in the annular passage 118 upstream from the reaction zone 54 (FIG. 2). The premixed fuel and air exits the annular passage 118, enters the reaction zone 54 and is combusted to provide the combustion gases 26.

Figure 5:
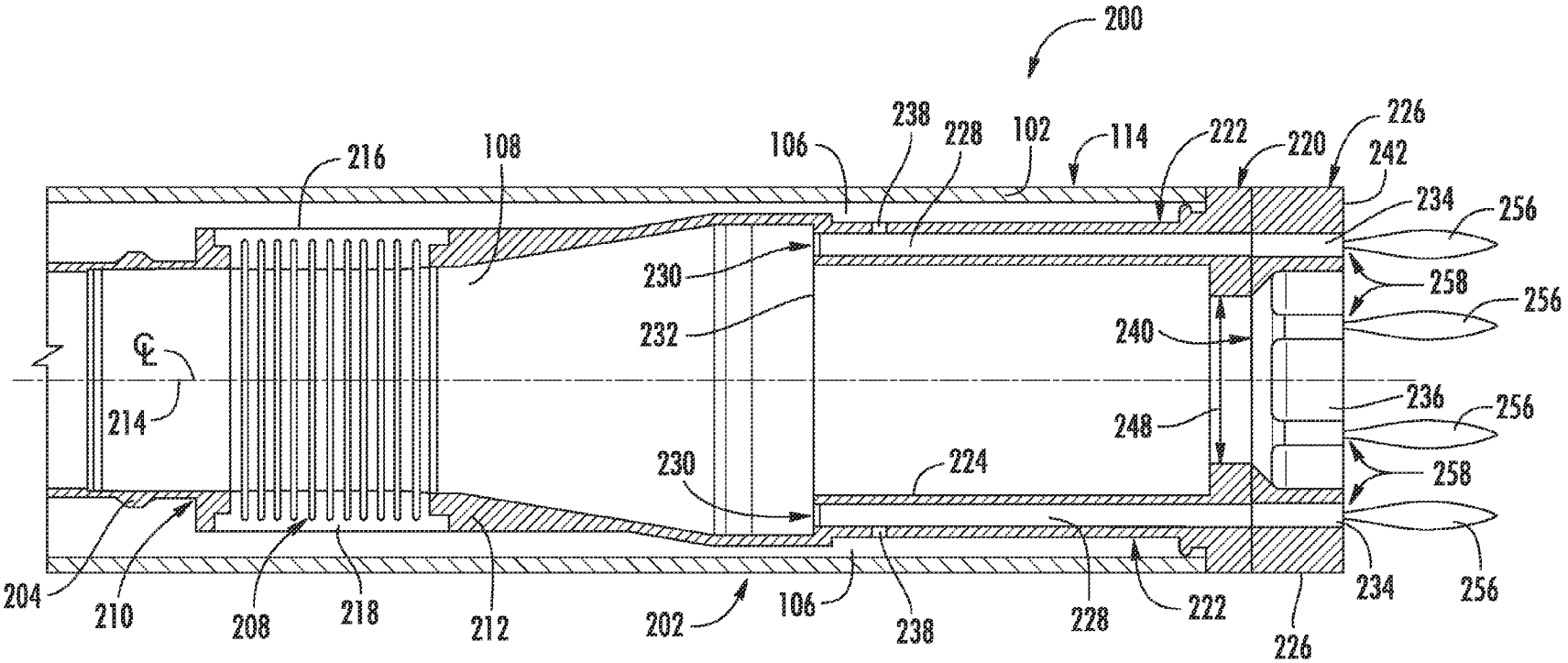
FIG. 5 is a cross sectioned side view of a portion of the fuel nozzle assembly as shown in FIGS. 3 and 4 according to at least one embodiment of the present invention.

In various embodiments, as shown in FIGS. 3 and 4, the fuel nozzle assembly 100 includes a premix pilot nozzle 200 that extends substantially axially within the center body 102. FIG. 5 provides an enlarged cross sectioned side view of a downstream end portion 202 of an exemplary premix pilot nozzle 200 as may be incorporated into the fuel nozzle assembly 100 (FIG. 3) and/or the combustor 24 as shown in FIG. 2, according to one or more embodiments of the present invention. As shown in FIGS. 3 and 5, the premix pilot nozzle 200 may include an annular stem 204. As shown in FIG. 3, a first or upstream end portion 206 of the stem 204 may be configured or formed to interface with and/or be connected to the end cover 44 (FIG. 2). The stem 204 may at least partially define the pilot fuel passage 106 and/or the pilot air passage 108.

As shown in FIG. 5, the premix pilot nozzle 200 may include an annular shaped bellows 208 that is coupled at one end to a downstream end portion 210 of the stem 204. In particular configurations, the bellows 208 may be coupled at a second end to a flow expansion collar 212. The stem 204, bellows 208 and flow expansion collar 212 may be coaxially aligned with respect to an axial centerline 214 of the premix pilot nozzle 200. The premix pilot nozzle 200 may further include an annular sleeve or liner 216 that circumferentially surrounds the bellows 208. In one embodiment, the liner 216 may form a plenum or void 218 between the bellows 208 and the liner 216. The liner 216 may be fixedly engaged or may be slideably engaged with the stem 204 and/or the flow expansion collar 212, thus allowing for thermal expansion between the stem 204 and the expansion collar 212.

In various embodiments, as shown in FIGS. 3, 4 and 5, the premix pilot nozzle 200 includes a tip portion 220. In particular embodiments, the tip portion 220 is coupled to and/or installed within the downstream end portion 114 of the center body 102. The tip portion 220 may be substantially annular and may extend axially downstream from the flow expansion collar 212 with respect to centerline 214. In particular embodiments, the tip portion 220 is coaxially aligned with one or more of the stem 204, the bellows 208 and the flow expansion collar 212. Each of the stem 204, the bellows 208, the flow expansion collar 212 and the tip portion 220 may at least partially define the pilot air circuit 108 through the center body 102 (FIG. 3).

In various embodiments, as shown in FIG. 5, the tip portion 220 includes a plurality of premix tubes 222 annularly arranged about or around the centerline 214. The premix tubes 222 may be defined or disposed radially between an inner wall 224 and an outer wall 226 of the tip portion 220. Each premix tube 222 extends substantially axially with respect to centerline 214. Each premix tube 222 defines a premix flow passage 228 through the tip portion 220 of the premix pilot nozzle 200.

As shown in FIG. 5, each premix tube 222 includes an inlet 230 defined along an upstream wall or surface 232 of the tip portion 220 and an outlet 234 that is axially offset from a downstream surface or wall 236 of the tip portion 220. The inlet 230 of each premix tube 222 is in fluid communication with the pilot air circuit 108. The outlet 234 of each premix tube 222 provides for fluid communication between the corresponding premix flow passage 228 and the combustion chamber or reaction zone 54 (FIG. 2). In particular embodiments, as shown in FIG. 5, each or at least some of the premix tubes 222 includes one or more fuel ports 238 which provide for fluid communication between the pilot fuel circuit 106 and a corresponding premix flow passage 228.

Figure 6:
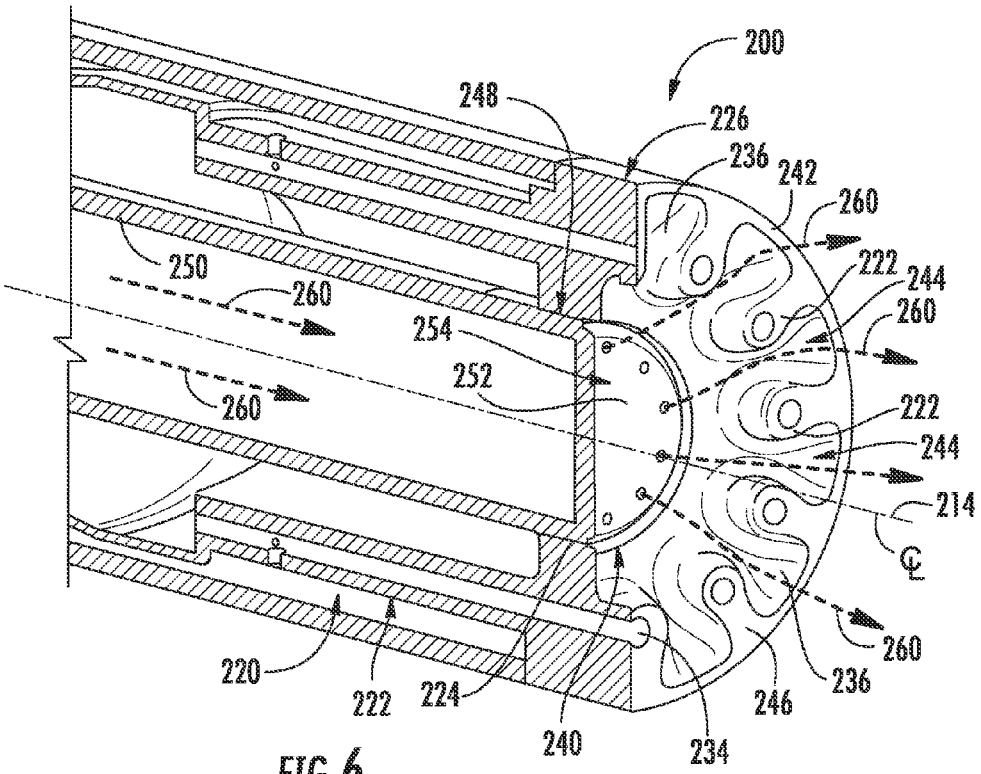
FIG. 6 is an enlarged perspective cross sectioned side view of a portion of the fuel nozzle assembly according to at least one embodiment of the present invention.

FIG. 6 is a perspective view of a portion of the tip portion 220 of the premix pilot nozzle 200 according to at least one embodiment of the present invention. As shown in FIGS. 5 and 6 a downstream end 240 of the inner wall 224 terminates axially upstream from a downstream end 242 of the outer wall 226 with respect to center line 214.

In various embodiments, as shown in FIG. 6, the downstream surface 236 of the tip portion 220 extends radially, axially and circumferentially between the downstream end 240 of the inner wall 224 of the tip portion 220 and the downstream end 242 of the outer wall 226 of the tip portion 220. As shown in FIG. 6, at least a portion of the downstream surface 236 of the tip portion 220 is substantially curvilinear and/or has a curvilinear cross sectional profile.

Figure 7:
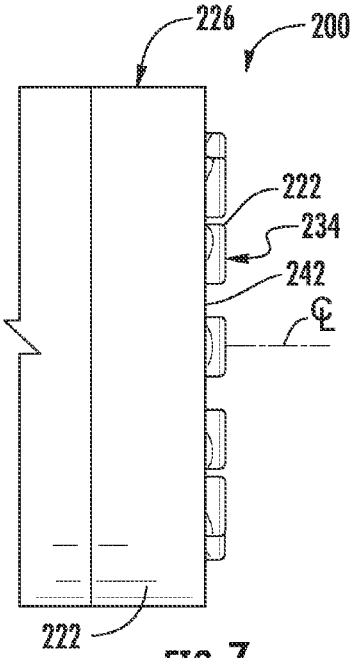
FIG. 7 is an enlarged perspective side view of a portion of the fuel nozzle assembly according to at least one embodiment of the present invention.

In various embodiments, as shown in FIGS. 5 and 6, each premix tube 222 terminates axially downstream from the downstream end 240 of the inner wall 224. In this manner, the outlet 234 of each premix tube 222 is axially offset from the downstream surface 236 and the downstream end 240 of the inner wall 224. In particular embodiments as shown in FIG. 6, at least one of the premix tubes 222 terminates substantially adjacent to or within a common radial plane of the downstream end 242 of the outer wall 226. In alternate embodiments, as shown in FIG. 7, at least one of the premix tubes 222 terminates at a point that is axially downstream from the downstream end 242 of the outer wall 226 with respect to centerline 214.

Figure 8:
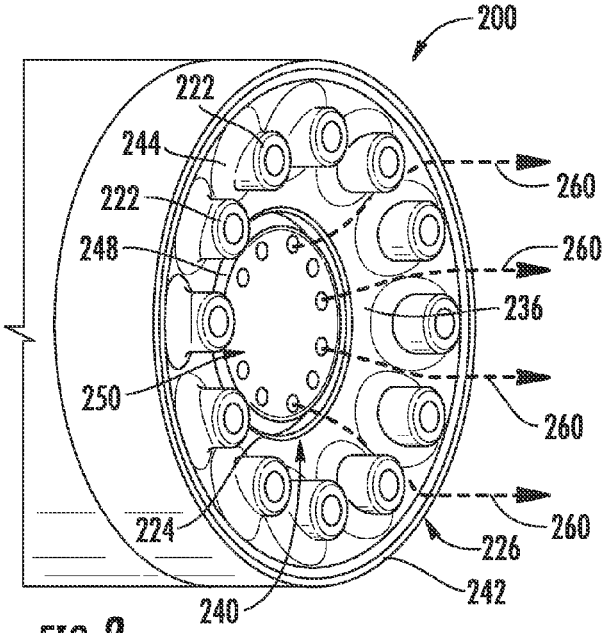
FIG. 8 is an enlarged side view of a portion of the fuel nozzle assembly according to at least one embodiment of the present invention.

FIG. 8 provides a perspective view of a portion of the premix pilot nozzle 200 according to various embodiments of the present invention. In various embodiments, as shown in FIGS. 6 and 8, at least a portion of the downstream surface 236 extends concavely between the downstream end 240 of the inner wall 224 and the downstream end 242 of the outer wall 226. In particular embodiments at least a portion of the downstream surface 236 curves around and/or forms a blend at least partially around the premix tubes 222. In particular embodiments, as shown in FIGS. 6 and 8, adjacent premix tubes 222 may define a cooling flow channel 244 therebetween along the downstream surface 236. In particular embodiments, as shown in FIG. 6, at least one of the premix tubes includes a bridge portion 246 that extends between the corresponding premix tube 222 and the outer wall 226 of the tip portion 220.

In various embodiments, as shown collectively in FIGS. 5 and 6, the inner wall 224 of the tip portion 220 defines an opening 248. As shown in FIG. 3, the opening 248 may be sized or configure to receive a cartridge 250. The cartridge 250 may comprise a gas only cartridge, an air purge cartridge, a liquid fuel cartridge or the like. As shown in FIG. 6 the cartridge 250 may include and/or define one or more cooling passages or holes 252 defined at or proximate to a downstream end 254 of the cartridge 250. The cartridge 250 may be configured to impart swirl to a cooling medium as it flows through the cartridge 250.

In piloted premix operation of the combustor 24, pilot fuel is supplied to the pilot fuel circuit 106 and pilot air is supplied to the pilot air circuit 108. The pilot air flows into the premix flow passages 228 via inlets 230. The pilot fuel is injected into the premix flow passages 228 via fuel ports 238. The pilot fuel and the pilot air mix within the premix flow passages 228 and a pre-mixed fuel-air mixture flows from the outlets 234 of the premix tubes 222 towards the combustion zone 54. As shown in FIG. 5, the pre-mixed fuel-air mixture is ignited so as to provide a pilot flame 256 at each premix tube 222 outlet 234.

As shown in FIG. 5, a base portion 258 of the pilot flame 256 resides at or proximate to the outlet 234 of each premix tube 222. A cooling medium such as compress air as air as indicated by arrows 260 in FIGS. 6 and 8, is supplied to the cartridge 250. The cooling medium 260 flows from the cooling passages 252 along the downstream surface 236 of the tip portion 220 of the premix pilot nozzle 200, thus providing cooling or film cooling to the downstream surface and/or the premix tubes 222. The cooling medium 260 may then exit the downstream surface 236 and carried off by the fuel and air mixture flowing from the annular passage 118 of the fuel nozzle assembly 100.

The curvilinear or concave shape of the downstream surface 236 of the premix pilot nozzle 200 keeps the film of the cooling medium 260 securely attached to the downstream surface 236 and may also allow for a thicker film of the cooling medium along the downstream surface 236. The cooling channels 244 defined between the adjacent premix tubes 222 route the cooling medium between and/or around downstream ends of premix tubes, thus providing cooling thereto.

By axially offsetting the premix tube outlets 234 from the downstream surface 236 and/or the downstream end 240 of the inner wall 224, the base portions 258 of the pilot flames 256 are lifted out of the film of the cooling medium 260. As a result, the cooling medium 260 does not strike or intersect with the base portion 258 of the pilot flames 256, thus having a minimal or zero net effect on reaction rates in the pilot flames 256 and pilot flame stability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fuel nozzle assembly, comprising: a center body that extends axially along a center line of the fuel nozzle assembly, the center body having a pilot fuel circuit and a pilot air circuit defined therein;

an outer sleeve coaxially aligned with the center body, wherein center body and the outer sleeve define an annular passage therebetween, the fuel nozzle further comprising a plurality of swirler vanes that extend between the center body and the outer sleeve within the annular passage;

a premix pilot nozzle that extends axially within the center body, the premix pilot nozzle having a tip portion, the tip portion comprising a downstream surface that extends between a downstream end of an inner wall of the tip portion and a downstream end of an outer wall of the tip portion, wherein the downstream end of the inner wall terminates axially upstream from the downstream end of the outer wall and wherein at least a portion of the downstream surface is curvilinear and at least a portion of the downstream surface extends concavely between the downstream end of the inner wall and the downstream end of the outer wall;

wherein the tip portion further comprises a plurality of axially extending premix tubes annularly arranged about the tip portion, wherein each premix tube includes an outlet axially offset from the downstream surface and wherein each tube defines a premix flow passage through the tip portion that terminates downstream from the downstream surface;

wherein adjacent premix tubes define a cooling flow channel therebetween along the concave portion of the downstream surface.

2. The fuel nozzle assembly as in claim 1, wherein the downstream surface curves at least partially around each of the premix tubes.

3. The fuel nozzle assembly as in claim 1, wherein the tip portion at least partially defines a fuel circuit within a center body of a fuel nozzle assembly, wherein each premix tube is in fluid communication with the fuel circuit.

4. The fuel nozzle assembly as in claim 1, wherein each premix tube includes a bridge portion that is connected to the outer wall of the tip portion.

5. The fuel nozzle assembly as in claim 1, wherein at least one of the premix tubes terminates adjacent to the downstream end of the outer wall.

6. The fuel nozzle assembly as in claim 1, wherein at least one of the premix tubes terminates downstream from the downstream end of the outer wall.

7. The fuel nozzle assembly as in claim 1, further comprising a cartridge that extends axially within the center body and the premix pilot nozzle, wherein the cartridge is configured to provide a cooling medium to the downstream surface of the tip portion of the premix pilot nozzle.

8. A combustor comprising: an end cover;

a plurality of fuel nozzle assemblies annularly arranged about a center fuel nozzle, each fuel nozzle assembly of the plurality of fuel nozzle assemblies and the center fuel nozzle being fixedly connected to the end cover, wherein at least one fuel nozzle assembly comprises;

a center body that extends axially along a center line of the fuel nozzle assembly, the center body having a pilot fuel circuit and a pilot air circuit defined therein;

an outer sleeve coaxially aligned with the center body, wherein center body and the outer sleeve define an annular passage therebetween, the fuel nozzle further comprising a plurality of swirler vanes that extend between the center body and the outer sleeve within the annular passage;

a premix pilot nozzle that extends axially within the center body, the premix pilot nozzle having a tip portion, the tip portion comprising a downstream surface that extends between a downstream end of an inner wall of the tip portion and a downstream end of an outer wall of the tip portion, wherein the downstream end of the inner wall terminates axially upstream from the downstream end of the outer wall and wherein at least a portion of the downstream surface is curvilinear and at least a portion of the downstream surface extends concavely between the downstream end of the inner wall and the downstream portion of the outer wall;

wherein the tip portion further comprises a plurality of axially extending premix tubes annularly arranged about the tip portion, wherein each premix tube includes an outlet axially offset from the downstream surface and wherein each tube defines a premix flow passage through the tip portion that terminates downstream from the downstream surface;

wherein adjacent premix tubes define a cooling flow channel therebetween along the concave portion of the downstream surface.

* * * * *